US006324123B1

(12) United States Patent
Durso

(10) Patent No.: US 6,324,123 B1
(45) Date of Patent: Nov. 27, 2001

(54) MEDICATION TIMER

(76) Inventor: Chris M. Durso, 4540 Dryden Rd., Port Arthur, TX (US) 77642

( * ) Notice: Subject to any disclaimer, the term of this patent is extended or adjusted under 35 U.S.C. 154(b) by 0 days.

(21) Appl. No.: 09/506,552

(22) Filed: Feb. 18, 2000

(51) Int. Cl.[7] ..... G04B 47/00

(52) U.S. Cl. ..... 368/10; 368/109; 221/2; 221/15

(58) Field of Search ..... 368/10, 109; 221/2, 221/15, 3

(56) References Cited

U.S. PATENT DOCUMENTS

| | | | | |
|---|---|---|---|---|
| D. 282,446 | | 2/1986 | Gremonprez et al. . | |
| 4,361,408 | | 11/1982 | Wirtschafter . | |
| 4,367,955 | * | 1/1983 | Ballew | 368/10 |
| 4,419,016 | * | 12/1983 | Zoltan | 368/10 |
| 4,768,176 | * | 8/1988 | Kehr et al. | 368/10 |
| 4,905,213 | | 2/1990 | Masse et al. . | |
| 5,233,571 | * | 8/1993 | Wirtshcafter | 368/10 |
| 5,313,439 | * | 5/1994 | Albeck | 368/10 |
| 5,347,453 | | 9/1994 | Maestre . | |
| 5,751,661 | * | 5/1998 | Walters | 368/10 |
| 6,169,707 | * | 1/2001 | Newland | 368/10 |
| 6,259,654 | * | 7/2001 | Da La Huerga | 368/10 |

* cited by examiner

*Primary Examiner*—Diego Gutierrez
*Assistant Examiner*—Jeanne-Marguerite Goodwin

(57) ABSTRACT

A medication timer for tracking when medication is to be taken. The medication timer includes a bottle for housing the medication. The bottle has an open end which has a lip. The lip has threads formed thereon. A first cap for removably closing the bottle has a first portion and a second portion. The first and second portions are generally annular. The first and second portions each has an interior threaded surface. A timer for tracking medication use has a top wall, a bottom wall and a peripheral side wall extending therebetween. The peripheral side wall has threads thereon. The peripheral side wall has a plurality of bores therein. Control circuitry is fixedly mounted in an interior of the timer. The control circuitry is adapted for tracking elapsing time, and adapted for activation of an alarm. A display for displaying information from the control circuitry is mounted on the control circuitry. The display is operationally coupled to the control circuitry. A button for programming the control circuitry is in each one of the bores in the timer.

9 Claims, 3 Drawing Sheets

FIG 1
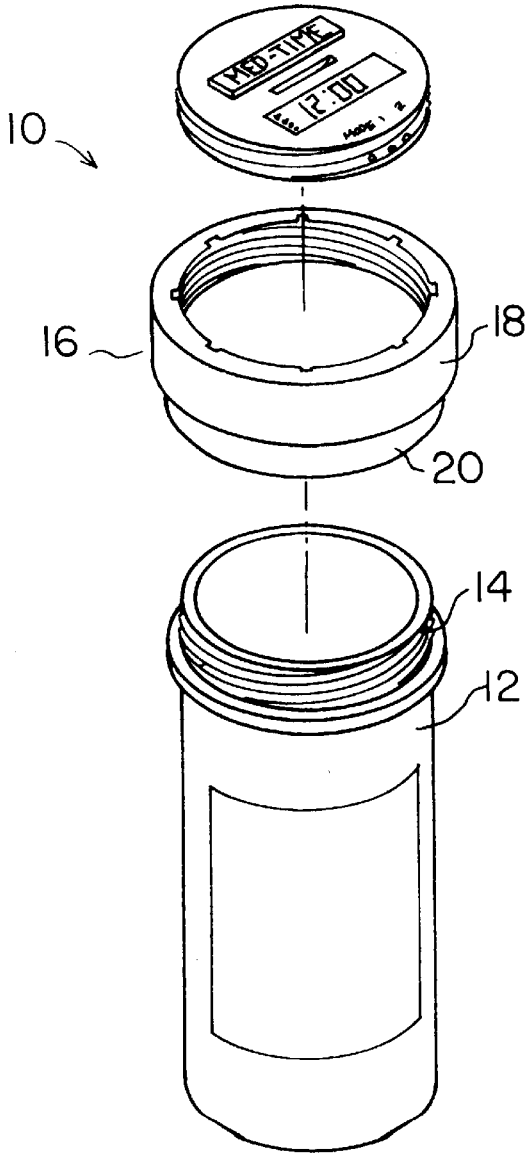
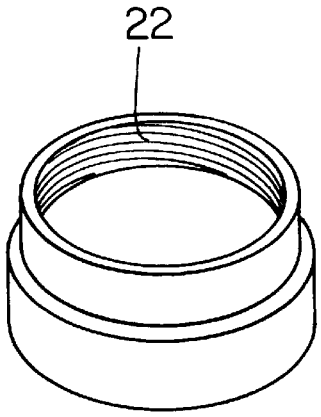
FIG 3
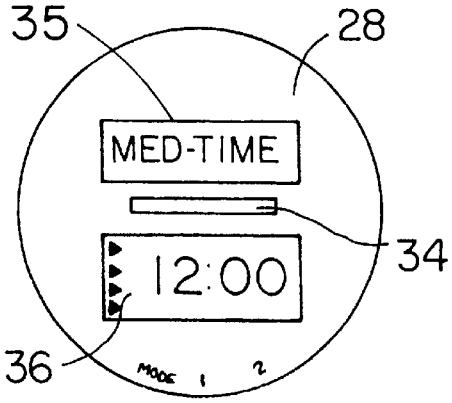
FIG 2

MEDICATION TIMER

BACKGROUND OF THE INVENTION

1. Field of the Invention

The present invention relates to timers and more particularly pertains to a new medication timer for tracking when medication is to be taken.

2. Description of the Prior Art

The use of timers is known in the prior art. More specifically, timers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,233,571; 5,347,453; 282,446; 4,905,213; 4,361,408; and U.S. Pat. No. 4,786,176.

While these devices fulfill their respective, particular objectives and requirements, the aforementioned patents fo not disclose a new medication timer. The inventive device includes a bottle for housing the medication. The bottle has an open end which has a lip. The lip has threads formed thereon. A first cap for removably closing the bottle has a first portion and a second portion. The first and second portions are generally annular. The first and second portions each has an interior threaded surface. A timer for tracking medication use has a top wall, a bottom wall and a peripheral side wall extending therebetween. The peripheral side wall has threads thereon. The peripheral side wall has a plurality of bores therein. Control circuitry is fixedly mounted in an interior of the timer. The control circuitry is adapted for tracking elapsing time, and adapted for activation of an alarm. A display for displaying information from the control circuitry is mounted on the control circuitry. The display is operationally coupled to the control circuitry. A button for programming the control circuitry is in each one of the bores in the timer.

In these respects, the medication timer according to the present invention substantially departs from the conventional concepts and designs of the prior art, and in so doing provides an apparatus primarily developed for the purpose of tracking when medication is to be taken.

SUMMARY OF THE INVEMTION

In view of the foregoing disadvantages inherent in the known types of timers now present in the prior art, the present invention provides a new medication timer construction wherein the same can be utilized for tracking when medication is to be taken.

The general purpose of the present invention, which will be described subsequently in greater detail, is to provide a new medication timer apparatus and method which has many of the advantages of the timers mentioned heretofore and many novel features that result in a new medication timer which is not anticipated, rendered obvious, suggested, or even implied by any of the prior art timers, either alone or in any combination thereof.

To attain this, the present invention generally comprises a bottle for housing the medication. The bottle has an open end which has a lip. The lip has threads formed thereon. A first cap for removably closing the bottle has a first portion and a second portion. The first and second portions are generally annular. The first and second portions each has an interior threaded surface. A timer for tracking medication use has a top wall, a bottom wall and a peripheral side wall extending therebetween. The peripheral side wall has threads thereon. The peripheral side wall has a plurality of bores therein. Control circuitry is fixedly mounted in an interior of the timer. The control circuitry is adapted for tracking elasping time, and adapted for activation of an alarm. A display for displaying information from the control circuitry is mounted on the control circuitry. The display is operationally coupled to the control circuitry. A button for programming the control circuitry is in each one of the bores in the timer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaning at least one embodiment of the invention in detail, it is to be understood that the invention is not limited in its application to the details of construction and to the arrangements of the components set forth in the following description or illistrated in drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore , that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical dislosure of the application. The abstract is neither intended to define the invention of the application, which is measured by the claims, nor is it intended to be limiting as to the scope of the invention in any way.

It is therefore an object of the present invention to provide a new medication timer apparatus and method which has many of the advantages of the timers mentioned heretofore and many novel features that result in a new medication timer which is not anticipated, rendered obvious, suggested, or even implied by any of the prior art timers, either alone or in any combination thereof.

It is another object of the present invention to provide a new medication timer which may be easily and efficiently manufactured and marketed.

It is a further object of the present invention to provide a new medication timer which is of a durable and reliable construction.

An even further object of the present invention is to provide a new medication timer which is susceptible of a low cost of manufacture with regard to both materials and labor, and which accordingly is then susceptible of low prices of sale to the consuming public, thereby making such medication timer economically available to the buying public.

Still yet another object of the present invention is to provide a new medication timer which provides in the apparatuses and methods of the prior art some of the advantages thereof, while simultaneously overcoming some of the disadvantages normally associated therewith.

Still another object of the present invention is to provide a new medication timer for tracking when medication is to be taken.

Yet another object of the present invention is to provide a new medication timer which includes a bottle for housing the medication. the bottle has an open end which has a lip. The lip has threads formed thereon. A first cap for removably closing the bottle has a first portion and a second portion. The first and second portions are generally annular. The first and second portions each has an interior threaded surface. A timer for tracking medication use has a top wall, a bottom wall and a peripheral side wall extending therebetween. The peripheral side wall has threads thereon. The peripheral side wall has a plurality of bores therein. Control circuitry is fixedly mounted in an interior of the timer. The control circuitry is adapted for tracking elapsing time, and adapted for activation of an alarm. A display for displaying information from the control circuitry is mounted on the control circuitry. The display is operationally coupled to the control circuitry. A button for programming the control circuitry is in each one of the bores in the timer.

Still yet another object of the present invention is to provide a new medication timer that is adaptable for larger or smaller bottles of medicine and can be attached to any cup.

Even still another object of the present invention is to provide a new medication timer that contains a pill container which is compartmentalized for holding multiple and differing pills in the same compartment to ensure all of the correct pills are taken at the same time.

Another object of the present invention is to provide a new medication timer that is removable from a disposable bottle. The bottle may be thrown away and the timer may be attached to another bottle to prevent contamination.

Yet another object of the present invention is to provide a new medication timer that has a housing which may be offered in different colors for distinguishing between medications.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a new medication timer according to the present invention.

FIG. 2 is a schematic plan view of the timer of the present invention.

FIG. 3 is a schematic perspective view of the first cap of the present invention.

DESCRIPTION OF THE PREFERRED EMBODIMENT

Figure 4:
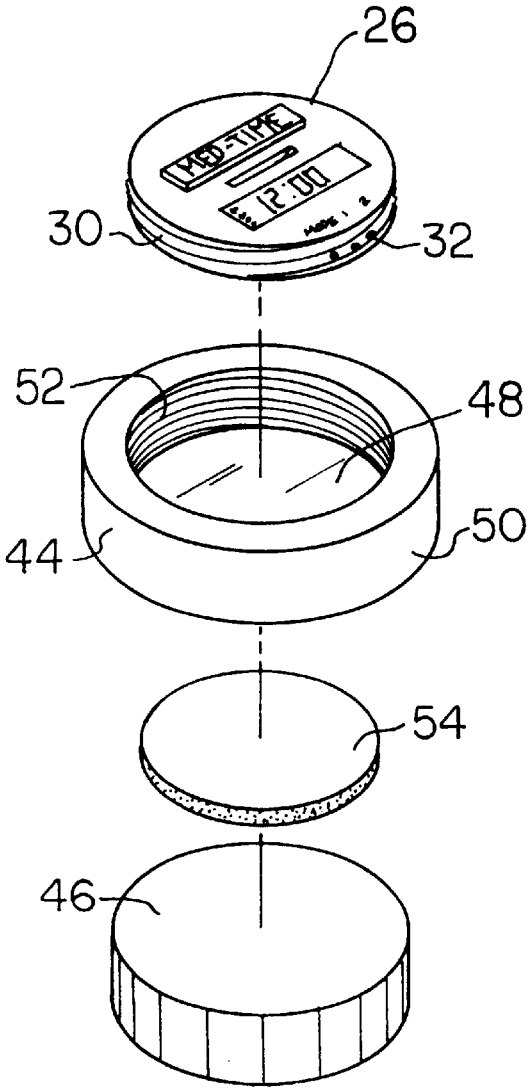
FIG. 4 is a schematic perspective view an adapter of the present invention.
Figure 5:
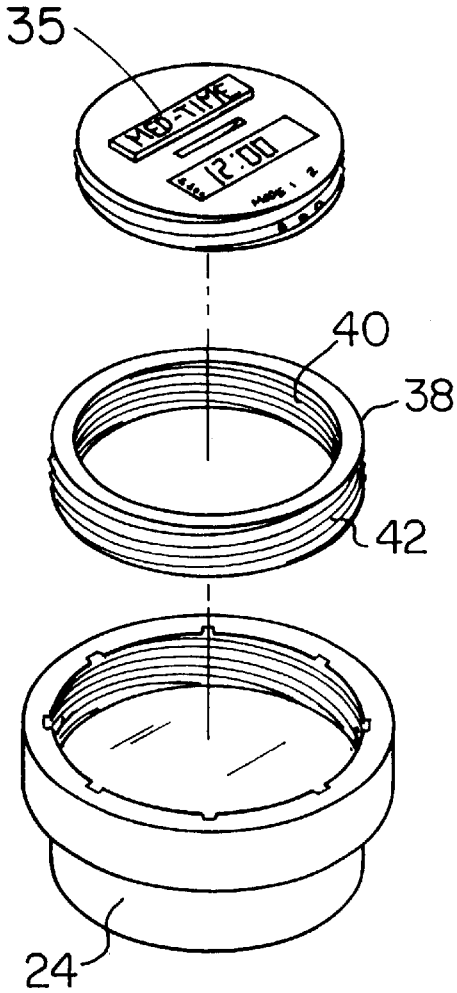
FIG. 5 is a schematic perspective view of an adapter and the second cap of the present invention.
Figure 6:
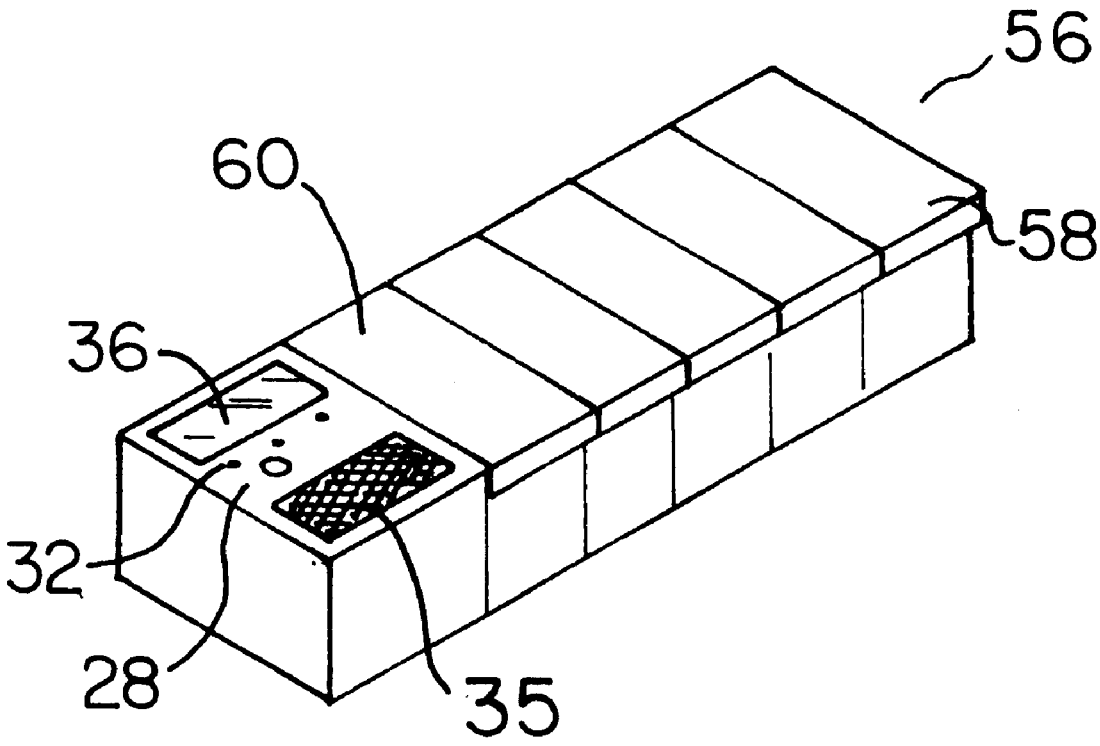
FIG. 6 is a schematic perspective view of a second container of the present invention.

With reference now to the drawings, and in particular to FIGS. 1 through 6 thereof, a new medication timer embodying the principles and concepts of the present invention and generally designated by the reference numeral 10 will be described.

As best illustrated in FIGS. 1 through 6, the medication timer 10 generally comprises a bottle 12 for housing the medication. The bottle has an open end which has a lip 14 thereon. The lip is annular and has threads formed thereon.

A first cap 16 for removably closing the bottle 12 has a first portion 18 and a second portion 20. The first 18 and second 20 portions are generally annular. The first 18 and second 20 portions each have an interior threaded surface 22. The first portion 18 is a child proof cap. The first 18 and second 22 portions are adapted to removably couple with the threads on the bottle 12. The first portion 18 is adapted to resist removal of the first cap 16 from the lip 14 of the bottle 12 by a child.

A second cap 24 removably closes bottles. The second cap 24 is generally identical to the first cap 16 has generally larger dimensions than the first cap such that the second cap 24 is adapted to fit on the lip of relatively larger bottles than the first cap 12. Both the first and second caps may be reversed so that a childproof side or a standard side may be used.

A timer for tracking medication use has a top wall 28, a bottom wall and a peripheral side wall 30 extending therebetween. The peripheral side wall 30 has threads thereon. The peripheral side wall 30 has three bores 32 therein. The threads on the peripheral wall of the timer may be removably coupled with the threads 22 in the first 18 or second portion 20 of the first cap 16. The bores are placed in a tamper resistant state when the timer is inserted into the first cap.

A slot 34 is preferably in a medical portion of the top wall of the timer. The slot 34 aids in removing the timer from the caps 16, 24.

Control circuitry is fixedly mounted in an interior of the timer 26. The control circuitry is adapted for tracking elapsing time, and adapted for activation of an alarm. The control circuitry comprising a microprocessor.

A raised acknowledgement button 35 is illustrated upon activation of the alarm. The user presses the button when they hear the alarm to turn the alarm off. The button 35 is operationally connected to the control circuitry.

A display 36 displays information from the control circuitry and is mounted on the control circuitry. A surface of the display 36 is generally flush with the top surface of the top wall 28 of the timer 26. The display 36 is operationally coupled to the control circuitry. Preferably, the display 36 comprises a liquid crystal display.

Three buttons are used for programming the control circuitry. One button is in each of the bores 32 in the timer such that the buttons are not accessible when the timer is threadably received in one of the caps. Each of the buttons is fixedly coupled to the control circuitry. A first adapter 38 allows the timer 26 to be inserted into the second cap 24. The first adapter 38 forms a ring having an interior 40 and exterior 42 surface. The interior 40 and exterior 42 surfaces are threaded. The timer 26 may be releasably coupled with the interior surface 40 of the ring. The exterior surface 42 of the first adapter may be releasably coupled with the threads in the second cap 24.

A second adapter 44 allows the timer 26 to be romvably coupled to a surface 46. The second adapter 44 has a bottom wall 48. The bottom wall 48 is generally annular shaped. A side wall 50 is fixedly coupled to and extends away from a peripheral edge of the bottom wall 48. The side wall 50 has an interior surface 52 adapted to releasably receive the timer 26.

A coupling patch 54 secures the bottom wall 48 of the second adapter 44 to a surface 46. The coupling patch 54 has a front side and a back side. The front and back sides of the coupling patch have adhesive thereon, wherein the front side of the coupling patch is secured to the bottom wall of the second adapter 44, and wherein the back side of the coupling patch is securable to surface 46.

The timer 26 is releasably inserted and removed from the first 38 or second 44 adapters or the first cap 16. An edge of an object is inserted in the slot 34 to turn the timer 26 with respect to the first cap and the first and second adapters.

A second container 56, forming a housing, is divided into a plurality of compartments 58. Each of the compartments has a lid 60 thereon which is hingedly connected to the second container 56.

A timer for tracking medication use s coupled to an end of the second container 56. The timer has a top wall 28. The top wall 28 has a plurality of bores 32 therein.

Control circuitry is fixedly mounted in an interior of the timer, and is adapted for tracking elapsing time, and adapted for activation of an alarm.

A display 36 for displaying information from the control circuitry is mounted on the control circuitry. The display is operationally coupled to the control circuitry.

A speaker, not shown, is mounted in the top wall of the timer and is operationally coupled to the control circuitry.

A plurality of buttons for programming the control circuitry is in one of the bores in the top wall of the timer.

In use, the timer 26 is programmed using the buttons located in the bores. The timer 26 will sound an alarm and illuminate the acknowledgment button 35 when medication is to be taken. The timer is adapted to fit in an adapter so that it can be attached to any lid of any medicine bottle.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationship for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim

1. A timed medication container for tracking times of medication use, said timed medication container comprising:

a bottle for housing the medication, said bottle having an open end, said open end having a lip thereon, said lip having threads formed thereon;

a first cap for removably closing said bottle, said first cap having a first portion and a second portion, said first and second portions being generally annular, said first and second portions each having an interior threaded surface;

a timer for tracking medication use, said timer having a top wall, a bottom wall and peripheral side wall extending therebetween, said peripheral side wall having threads thereon, said peripheral side wall having a plurality of bores therein;

control circuitry being fixedly mounted in an interior of said timer, said control circuitry being adapted for tracking elapsing time, and adapted for activation of an alarm;

a display for displaying information from said control circuitry, said display being mounted on said control circuitry, said display being operationally coupled to said control circuitry; and a plurality of buttons for programming said control circuitry, each of said buttons being in one of said bores in said timer.

2. The timed medication container for tracking times of medication use as in claim 1, wherein said first cap further comprises:

said first cap being reversable, said first portion being a child proof cap, said first and second portions being adapted to removably couple wit said threads on said bottle, said first portion being adapted to resist removal of said first cap from the lip of said bottle by a child.

3. The timed medication container for tracking times of medication use as in claim 1, further comprising:

a second cap removably closing bottles, said second cap being generally indentical to said first cap, said second cap having generally larger dimensions than said first cap such that said second cap is adapted to fit on the lip of relatively larger bottles than said first cap; and a first adapter for allowing said timer to be inserted into said second cap, said first adapter forming a ring having an interior and exterior surface, said interior and exterior surfaces being threaded, wherein said timer may be releasably coupled with said interior surface of said first adapter, wherein said exterior surface of said first adapter may be releasably coupled with said threads in said second cap.

4. The timed medications container for tracking times of medication use as in claim 1, wherein said time further comprises:

said control circuitry comprising a microprocessor;

a surface of said display being generally flush with said top surface of said top wall of said timer, wherein said display comprises a liquid crystal display.

5. The timed medication container for tracking times of medication use as in claim 1, further comprising:

a second adapter for allowing said timer to be removably coupled to a surface, said second adapter having a bottom wall, said bottom wall being generally annular shaped, a side wall being fixedly coupled to and extending away from a peripheral edge of said bottom wall, said side wall having an interior surface, said interior surface being adapted to releasably receive said timer; and a coupling patch for securing said bottom wall of said second adapter to a surface, said coupling patch having a front side and a back side, said front and back sides of said coupling patch having adhesive thereon, wherein said front side of said coupling patch is secured to said bottom wall of said second adapter, wherein said back side of said coupling patch is securable to a surface.

6. The timed medication container for tracking times of medication use as in claim 1, further comprising:

a container, said second container forming a housing, said container being divided into a plurality of compartments, each of said compartments having a lid thereon, each of said lids being hingedly connected to said container;

a timer for tracking medication use, said timer being coupled to an end of said second container, said timer having atop wall, said top wall having a plurality of bores therein;

control circuitry being fixedly mounted in an interior of said timer, said control circuitry being adapted for tracking elapsing time, and adapted for activation of an alarm;

a display for displaying information from said control circuitry, said display being mounted on said control circuitry, said display being operationally coupled to said control circuitry; and a plurality of buttons for programming said control circuitry, each of said buttons being in one of said bores in said top wall of said timer.

7. The timed medication container for tracking times of medication use as in claim 1, further comprising:

a slot, said slot being in a medial portion of said top wall of said timer.

8. A timed medication container kit for tracking times of medication use, said timer medication container comprising:

a bottle for housing the medication, said bottle having an open end, said open end having a lip thereon, said lip being annular, said lip having threads formed thereon;

a first cap for removably closing said bottle, said first cap having a first portion and a second portion, said first and second portion being generally annular, said first and second portions each having an interior threaded surface, said first portion being a child proof cap, said first and second portions being adapted to removably couple with said threads on said bottle, said first portion being adapted to resist removal of said first cap from the lip of said bottle by a child;

a second cap for removably closing bottles, said second cap being generally indentical to said first cap, said second cap having generally larger dimensions than said first cap such that said second cap is adapted to fit on the lip of relatively larger bottles than said first cap;

a timer for tracking medication use, said timer having a top wall, a bottom wall and a peripheral side wall extending therebetween, said peripheral side wall having threads theron, said peripheral side wall having three bores therein, wherein said threads on said peripheral wall of said timer may be removably coupled with said threads in said first or second portion of said first cap;

a slot, said slot being in a medical portion of said top wall of said timer;

control circuitry being fixedly mounted in an interior of said timer, said control circuitry being adapted for tracking elapsing time, and adapted for activation of an alarm, said control circuitry comprising a microprocessor;

a desplay for displaying information from said control circuitry, said display being mounted on said control circuitry, a surface of said display being generally flush with said top surface of said top wall of said timer, said display being operationally coupled to said control circuitry, wherein said display comprises a liquid crystal display;

three buttons for progamming said control circuitry, each of said buttons being in one of said bores in said timer such that said buttons are not accessible when said timer is threadably received in one of said caps, each of said buttons being fixedly coupled to said control circuitry;

first adapter for allowing said timer to be inserted into said second cap, said first adapter forming a ring having an interior and exterior surface, said interior and exterior surfaces being threaded, wherein said timer may be releasably coupled with said interior surface of said first adapter, wherein said exterior surface of said first adapter may be releasably coupled with said threads in said second cap;

a second adapter for allowing said timer to be removably coupled to a surface, said second adapter having a bottom wall, said bottom wall being generally annular shaped, a side wall being fixedly coupled to and extending away from a peripheral edge of said bottom wall, said side wall having an interior surface, said interior surface being adapted to releasably receive said timer;

a coupling patch for securing said bottom wall of said second adapter to a surface, said coupling patch having a front side and a back side, said front and back sides of said coupling patch having adhesive thereon, wherein said front side of said coupling patch is secured to said bottom wall of said second adapter, wherein said back side of said coupling patch is securable to a surface; and wherein said timer is releasably inserted and removed from said first and second adapters and said first cap, wherein an edge of an object is inserted in said slot to turn said timer with respect to said first cap and said first and second adapters.

9. The timed medication container kit for tracking times of medication use as in claim 8, further comprising:

a container, said container forming a housing, said container being divided into a plurality of comparments, each of said compartments having a lid thereon, each of said lids being hingedly connected to said container;

a timer for tracking medication use, said timer being coupled to an end of said container, said timer having a top wall, said top wall having a plurality of bores therein;

control circuitry being fixedly mounted in an interior of said timer, said control circuitry being adapted for tracking elapsing time, and adapted for activation of an alarm;

a display for displaying information from said control circuitry, said display being mounted on said control circuitry, said display being operationally coupled to said control circuitry; and a plurality of buttons for programming said control circuitry, each of said buttons being in one of said bore in said top wall of said timer.

* * * * *